US005727338A

United States Patent [19]

George et al.

[11] Patent Number: 5,727,338

[45] Date of Patent: Mar. 17, 1998

[54] VACUUM FITTING SKI BOOT WITH AIR PUMP

[75] Inventors: Virginia C. George, 8164 Capitola Ave., Fair Oaks, Calif. 95628; Frederick W. George, Fair Oaks, Calif.

[73] Assignee: Virginia C. George, Fair Oaks, Calif.

[21] Appl. No.: 711,113

[22] Filed: Dec. 23, 1996

[51] Int. Cl.[6] ..... A43B 5/04; A43B 5/16

[52] U.S. Cl. ..... 36/93; 36/117.6

[58] Field of Search ..... 36/93, 109, 117.6, 36/117.7, 118.2

[56] References Cited

U.S. PATENT DOCUMENTS

| | | | |
|---|---|---|---|
| 3,786,581 | 1/1974 | Mochizuki | 36/118.2 |
| 4,420,893 | 12/1983 | Stephan | 36/3 |
| 4,654,986 | 4/1987 | George | 36/119 |
| 4,724,626 | 2/1988 | Baggio | 36/117 |
| 4,730,403 | 3/1988 | Walkhoff | 36/119 |
| 5,375,345 | 12/1994 | Djuric | 36/3 |

*Primary Examiner*—Paul T. Sewell
*Assistant Examiner*—Anthony Stashick
*Attorney, Agent, or Firm*—Flehr Hohbach Test Albritton & Herbert LLP

[57] ABSTRACT

A vacuum fitted ski boot which includes an air pump for automatically pumping air from an interior cavity within the boot for holding the requisite vacuum to maintain a close-fitting contact between the user's foot and the boot. An ankle cuff is mounted for relative angular movement with respect to a boot shell. A vacuum pump is mounted on the boot and is operated responsive to angular movement of the ankle cuff when there is flexing motion between the user's lower leg and foot during skiing. In different embodiments the pump can be mounted on the anterior, posterior, medial or lateral sides of the boot. In another embodiment the pump is comprised of an envelope which is fitted between the boot sole and the instep of the user's foot. The envelope has wall portions which define an interior cavity, and the wall portions are caused to undergo movement toward and away from each other responsive to pronation and supination movement of the foot during skiing to pump air out from the interior cavity of the boot.

7 Claims, 3 Drawing Sheets

VACUUM FITTING SKI BOOT WITH AIR PUMP

BACKGROUND OF THE INVENTION

1. Field of the Invention

This invention relates in general to ski boots, and more particularly relates to vacuum fitting ski boots.

2. Description of the Related Art

In Alpine or downhill-type skiing it is desirable to achieve a close fit of the foot within the ski boot for optimum "foot feel" while skiing. It is also desirable to provide a degree of forward flexing of the lower leg relative to the ski while maintaining lateral stiffness within the boot for proper ski edge control.

Certain conventional ski boots have been designed to achieve a close fit with the user's foot by means of a rigid outer shell having a padded inner liner which is tightened by buckles and/or straps to provide a vise-like pressure about the foot and ankle. Another design uses an elastomeric slipper which is cast within the outer shell so as to conform to the contour of the user's foot. In that design when the shell is buckled together the slipper is pressed into a tight-fitting contact about the foot. These designs lead to a number of problems, including the "tourniquet effect" caused by contact pressure against the foot which in turn results in blood circulatory problems as well as discomfort. In these prior ski boots the attempt to achieve a close fit also limits the forward flexing capability of the boot.

Many of the foregoing problems and limitations with conventional Alpine ski boots have been obviated by a vacuum fitting ski boot design as disclosed in U.S. Pat. No. 4,654,986 issued Apr. 7, 1987 to Frederick W. George, one of the co-inventors of the present invention. In the ski boot of the George patent a rigid outer shell is formed in sections which permit articulation, and padded liners are mounted within the shell. A flexible sheath secured to the shell forms an hermetical seal about the user's lower leg. A partial vacuum is then formed within the boot to cause contraction of the boot shell and expansion of the foot to establish a close fit within the boot. The boot provides lateral stiffness while permitting forward flexing, and the close fit enables the user's to achieve more precise control during skiing.

During use of a vacuum fitting ski boot of the type described in the George patent, there is a gradual loss of vacuum due to air leaking into the flexible sheath as a result of the slight porosity of the sheath as well as the imperfect sealing between the sheath and the user's skin. As a result, it is necessary for the user to periodically stop skiing and use a pump, such as a hand-held pump, to withdraw additional air from the boot and reestablish the desired vacuum level. This procedure is inconvenient and interferes with the skiing routine.

The need has therefore been recognized for a vacuum fitting ski pump which obviates the foregoing and other limitations and disadvantages of prior art ski boots. Despite the various ski boots in the prior art, there has heretofore not been provided a suitable and attractive solution to these problems.

OBJECTS AND SUMMARY OF THE INVENTION

It is a general object of the present invention to provide a new and improved vacuum fitting ski boot which automatically and continuously maintains the desired level of vacuum within the boot without the skier stopping or otherwise interfering with skiing.

Another object is to provide a vacuum fitting ski boot of the type described which prevents loss of vacuum within the boot to maintain a close fit of the foot within the boot while obviating circulatory problems and discomfort and while maintaining the desirable "foot feel" for ski control.

Another object is to provide a vacuum fitting ski boot of the type described which utilizes the natural motion of the user's lower legs during skiing to automatically pump air from the boot and maintain the desired vacuum level.

The invention in summary provides a vacuum fitting ski boot having a shell with an interior cavity adapted to fit about the user's foot. An ankle cuff which fits about the user's ankle and lower leg is mounted on the boot for relative angular movement responsive to the flexing motion between the user's lower leg and foot during skiing. A vacuum pump is operated by natural skiing motion for pumping air from the interior cavity to maintain the vacuum level. In certain embodiments the pump comprises a housing and sliding piston which are mounted between different portions of the boot and cuff so that the piston reciprocates to pump the air as the ankle cuff undergoes its angular movement. In another embodiment the pump comprises a bladder-shaped envelope which is fitted below the instep of the foot and above the boot sole so that natural pronation and supination motions of the foot during skiing cause the envelope to expand and contract for pumping air from the boot.

The foregoing and additional objects and features of the invention will appear from the following specification in which the several embodiments have been set forth in detail in conjunction with the accompanying drawings.

DESCRIPTION OF THE PREFERRED EMBODIMENTS

Figure 1:
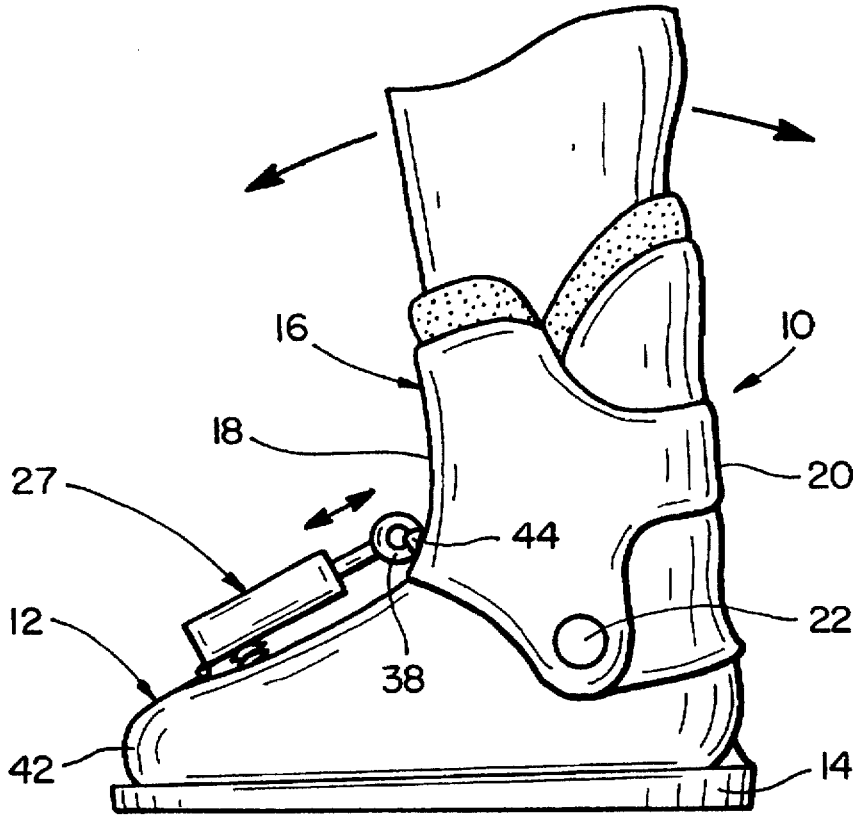
FIG. 1 is a side elevation view of a ski boot in accordance with one embodiment.
Figure 2:
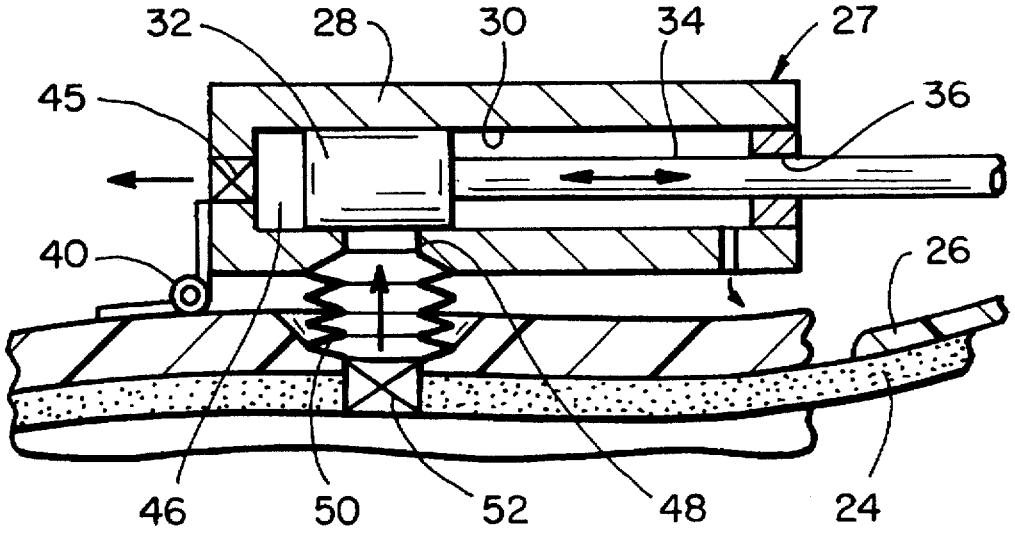
FIG. 2 is a fragmentary axial section view of the air pump in the boot of FIG. 1.
Figure 3:
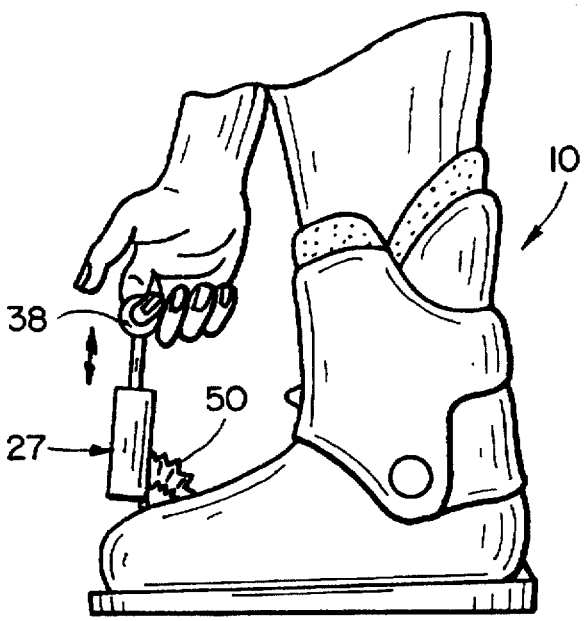
FIG. 3 is a view similar to FIG. 1 showing the air pump in a manually-operated mode.

In the drawings FIGS. 1–3 illustrate generally at 10 a vacuum fitted ski boot in accordance with one embodiment of the invention.

Ski boot 10 is comprised of a rigid outer shell 12 mounted above a sole 14 which is adapted to fit into the bindings of an Alpine-type ski, not shown. An ankle cuff 16 is provided and comprises an anterior side 18 and posterior side 20. The anterior and posterior sides are mounted to the boot's outer shell by hinges 22 provided on opposite sides of the boot.

The hinges permit both sides of the ankle cuff to undergo a range of forward and backward relative angular movement with respect to the boot shell responsive to the natural flexing motion between the user's lower leg and foot that results almost continuously during downhill skiing. The ski boot 10 illustrated in FIG. 1 is adapted for fitting about the right foot of the user, and a similar ski boot of mirror image shape, not shown, would be fitted on the left foot.

Outer shell 12 is formed of a material providing strength and rigidity, and a synthetic polymer such as one of polyvinylchloride products is suitable for this purpose. The shell can be formed with a plurality of stiffening battens, not shown, of the type described in U.S. Pat. No. 4,654,986, the disclosure of which is incorporated by this reference. The inside surfaces of the outer shell carry a padded liner 24 (FIG. 2) formed of suitable conformable material such as felt or plastic. The liner portions which bridge across the spacing between the stiffening battens provide flexible diaphragms which permit a degree of expansion and contraction in the manner explained in U.S. Pat. No. 4,654,986.

A thin sheath 26 formed of a suitable flexible, gas-impervious material such as latex rubber has an upper annular cuff, not shown, which closely fits about the upper calf or the lower leg of the user to provide a leak-proof seal in the manner described in U.S. Pat. No. 4,654,986. The sheath extends down and around the user's ankle where it is joined and sealed with padded liner as shown in FIG. 2. When a partial vacuum is formed within the sheath and padded liner, an hermetical seal is created around the user's lower calf, ankle and foot.

The desired level of vacuum is maintained by means of an air pump 27. The air pump is comprised of a cylindrical housing 28 having a central bore 30 which is fitted with a reciprocating piston 32. A rod 34 carried by the piston extends through an opening 36 in the end of the housing. The distal end of the rod carries a ring 38 which is suitably sized to provide a finger hole. The proximal end of the pump housing is pivotally mounted by hinge 40 to the toe portion 42 of the boot, and a quick release clip 44 secured to the anterior side of the cuff captures ring 38 to releasably hold the distal end of the piston rod. The ring is loosely held by the clip so that it can pivot through a small angle within the clip as the cuff pivots relative to the boot shell. The head end of the pump housing is formed with an outlet which is fitted with an outlet check valve 45 that enables one-way air flow out to atmosphere from the chamber 46 that is formed within the housing at the head of the piston. The lower side of the housing is formed with an inlet 48 that is connected with a flexible conduit, shown as a bellows 50, which in turn is connected to an inlet check valve 52 fitted within an opening formed in toe portion 42. Check valve 52 provides pneumatic communication in a one-way flow from the interior cavity of the boot shell into chamber 46 of the pump housing.

In the use and operation of the invention, ski boot 10 is fitted on the user's foot and the boot sole is then secured to the ski binding. When it is desired to create a vacuum within the boot prior to skiing, the user reaches down to release ring 38 from clip 44 and then pivots the pump housing up to the position shown in FIG. 3. With the user's finger placed through the ring, the rod is manually pulled up and pushed down to reciprocate the piston within the pump cylinder. As the piston is moved up air is withdrawn from the interior cavity of the boot through inlet check valve 52 and into the pump chamber. As the piston is returned down, the inlet check valve 45 closes while outlet check valve opens to exhaust air into the atmosphere. When the desired level of vacuum is achieved, the pump housing is pivoted back to the position shown in FIG. 1 and the piston rod ring is again secured to the release clip. The process is repeated for the opposite boot, and the user can then begin skiing.

During skiing air tends to leak from atmosphere into the vacuum within the interior cavity of the boot. This air leakage is replenished to maintain the desired vacuum level by the pumping action which results from the natural flexing motion between the user's lower leg and foot during skiing. The flexing motion causes forward and backward angular movement of the ankle cuff relative to the boot shell. This angular movement in turn causes reciprocating motion of the piston within the pump housing so that an automatic and substantially continuous pumping action is established to withdraw air from the boot as long as the angular movement continues.

As desired, the user could also initially begin skiing to draw down the vacuum within the interior cavity without going through the manual pumping procedure described above.

Figure 4:
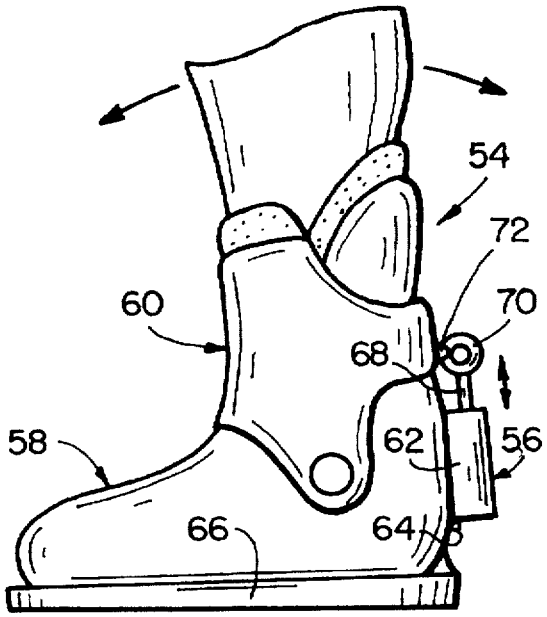
FIG. 4 is a side elevation view of a ski boot in accordance with another embodiment.

FIG. 4 illustrates another embodiment providing a vacuum fitted ski boot 54 having an air pump 56 which is located on the posterior side. This embodiment employs the boot shell 58 and ankle cuff 60 as in the embodiment of FIGS. 1–3 except that the pump housing 62 extends upright with its proximal end pivotally mounted by a hinge 64 to the bottom portion of the boot heel 66. Piston rod 68 extends upward with its ring 70 releasably attached to a quick release clip 72 mounted on the posterior side of the cuff. A flexible bellows, not shown, connected with an inlet into the pump housing is coupled with a one-way check valve, also not shown, that is fitted in an opening formed through the heel to provide pneumatic communication from the interior cavity of the boot into the pump. Forward and backward angular movement of the ankle cuff relative to the boot shell during skiing reciprocates the piston up and down to provide substantially continuous pumping action to hold the requisite vacuum within the boot and maintain a close fitting contact between the user's foot and boot.

Figure 5:
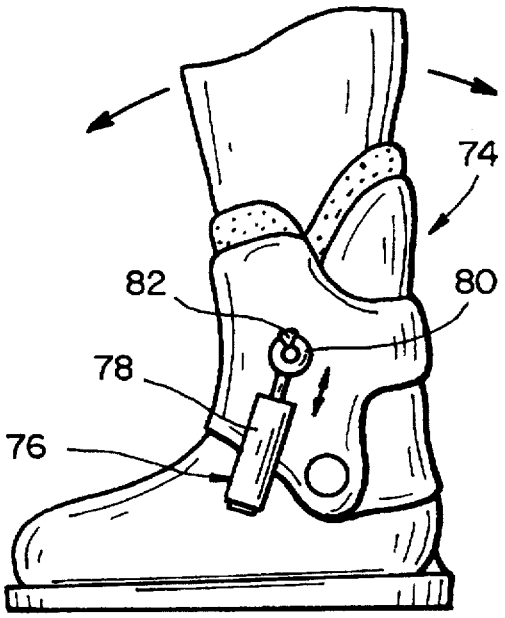
FIG. 5 is a side elevation view of a ski boot in accordance with another embodiment.

FIG. 5 illustrates another embodiment providing a ski boot 74, adapted for wearing on the user's right foot, in which the air pump 76 is mounted on the medial side of the boot. The ski boot is comprised of a boot shell and ankle cuff as in the embodiment of FIGS. 1–3. The proximal end of pump housing 78 is mounted upright to the boot shell at its medial side, and the piston rod ring 80 is releasably mounted to a quick release clip 82 which is secured to the medial side of cuff. A flexible bellows, not shown, is mounted between an inlet on the side of the pump housing and a one-way check valve, also not shown, fitted in an opening formed through the medial side of the boot shell to provide pneumatic communication with the interior cavity of the boot. The piston rod is reciprocated up and down responsive to the forward and backward angular movement of the cuff during normal skiing so that air is pumped out of the interior cavity to maintain the desired vacuum level.

Figure 6:
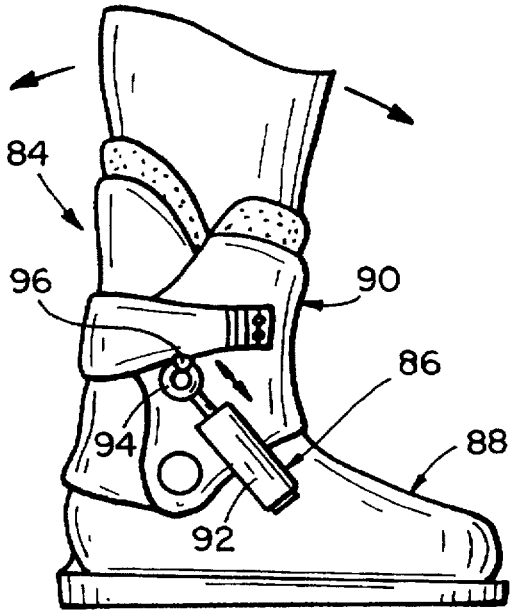
FIG. 6 is a side elevation view of a ski boot in accordance with another embodiment.

FIG. 6 illustrates another embodiment providing a ski boot 84, adapted for wearing on the right foot, in which the air pump 86 is mounted on the lateral side. Ski boot 84 is comprised of a boot shell 88 and ankle cuff 90 the manner described for the embodiment of FIGS. 1–3. The proximal end of pump housing 92 is pivotally mounted to the lateral side of the boot shell while the ring 94 on the end of the piston rod is releasably mounted to a quick release clip 96 which is mounted to the lateral of the ankle cuff. A flexible bellows, not shown, is mounted between an inlet on the side of the pump housing and a check valve, also not shown, which is fitted to an opening in the side of the boot shell. Forward and backward pivotal movement of the ankle cuff during normal skiing causes the piston rod to reciprocate and pump air from the interior cavity to maintain the desired level of vacuum within the boot.

Figure 7:
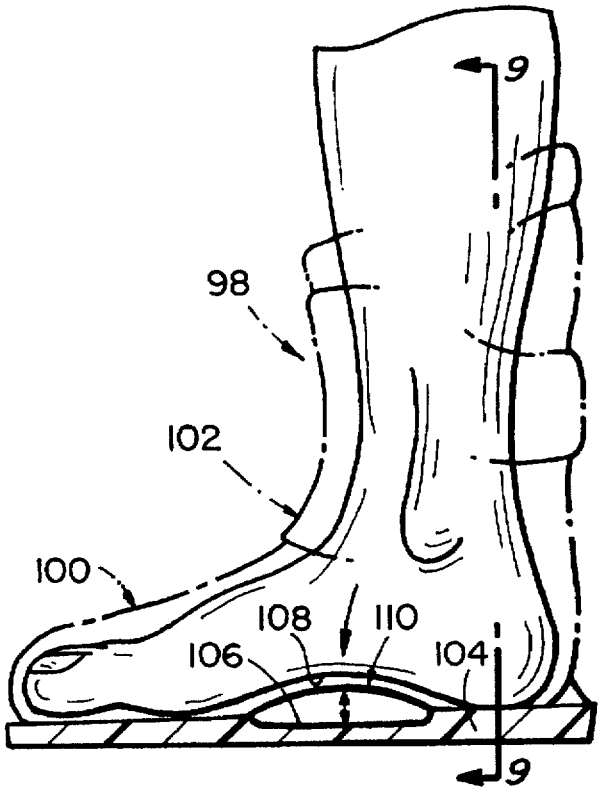
FIG. 7 is a fragmentary axial section view of a ski boot in accordance with another embodiment.
Figure 9:
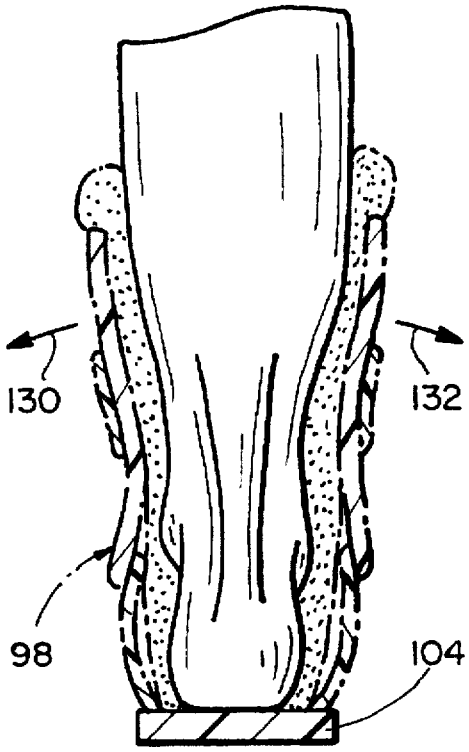
FIG. 9 is a vertical section view taken along the line 9—9 of FIG. 7 showing the user's foot, ankle and lower leg in relation to the ski boot sole.
Figure 8:
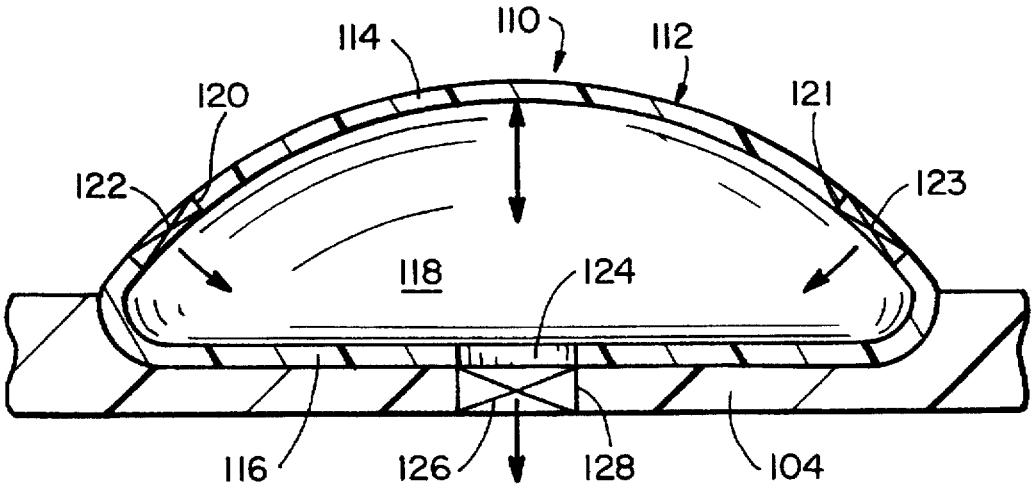
FIG. 8 is an axial section view to an enlarged scale showing details of the air pump in the boot of FIG. 7.

FIGS. 7–9 illustrate another embodiment providing a vacuum fitted ski boot 98 which pumps air responsive to pronation and supination movement of the user's foot during skiing. Ski boot 98 is comprised of a boot shell 100 and ankle cuff 102 made in accordance with the embodiment of FIGS. 1–3 and adapted for the user's right foot. The boot includes a sole 104 which has an instep portion 106 that underlies the instep 108 of the user's foot. A vacuum pump 110 is mounted within the interior cavity above the instep portion.

Pump 110 is comprised of an envelope 112 having upper and lower wall portions 114, 116 which are joined together to define a pumping chamber 118. One or more inlets 120, 121 are formed in the upper wall portion, and check valves 122 and 123 are fitted within the inlets for directing one-way flow of air from the interior cavity between the boot and user's foot into the pumping chamber. The lower wall portion is formed with at least one outlet 124 which connects with a check valve 126 fitted in an opening 128 through boot sole 104. Check valve 126 directs one-way flow of air from the pumping chamber out to the atmosphere.

Upper wall portion 114 of the pump is formed to be sufficiently yieldable to move down responsive to a downward load force from the instep of the user's foot, and means is provided for applying a restoring force for moving the upper wall portion back upwardly when the load force is at least partially removed. In the illustrated embodiment this means is provided by forming at least the upper wall portions of a suitable resilient elastomeric material such as rubber. The elastic memory of the upper wall provides the restoring force. The pump thereby acts in the manner of a flexible bladder in that the upper wall portion yieldably collapses down responsive to the downward load force from the user's instep, and when this load is released the upper wall expands up back toward its original position. As the upper wall collapses, inlet check valve 122 closes while outlet check valve 126 opens so that air is forced out of the pumping chamber. As the upper wall expands back up, the outlet check valve closes while the inlet check valve opens such that the expanding volume of the pumping chamber draws air in from the interior cavity between the boot and user's foot.

In FIG. 9 the rear view of the user's right foot and lower leg shown on top of the boot sole illustrates the direction of pronation and supination movement which causes pump 110 to operate. During certain portions of the skiing action, the lower leg and ankle will tend to rotate through a small arc relative to sole 104 about a forward axis toward the medial side in the direction shown by arrow 130. This is defined as pronation movement. During other portions of the skiing action, the foot and ankle will tend to rotate through a small arc relative to the sole about the forward axis toward the lateral side in the direction shown by arrow 132. This is defined as supination movement. With the pump 110 fitted below the user's instep, the pronation movement causes the instep to exert a downward load force against the upper wall of the pump so that air is pumped out of the pumping chamber. During the supination movement the instep is drawn away from the pump to permit the upper wall to elastically expand for drawing air into the pumping chamber from the boot's interior cavity.

The invention also contemplates that the means for applying the restoring force for moving the pump upper wall could be provided by fitting a compression spring, not shown, within pumping chamber 118 so that the spring is compressed and stores energy as the pump wall collapses under load, and as the load is removed the spring releases its stored energy for expanding the pump wall upwardly.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. A vacuum fitted ski boot which automatically pumps air for holding a vacuum within the boot to maintain a close-fitting contact between the user's foot and the boot, the ski boot comprising the combination of a boot shell having toe and heel portions, said boot shell further having an interior cavity adapted for fitting about the user's foot; an ankle cuff adapted for fitting about the user's ankle and a portion of the user's lower leg; means for mounting the ankle cuff for relative angular movement with respect to the boot shell responsive to flexing motion between the user's lower leg and foot; a vacuum pump, said pump being operable for pumping air from the interior cavity; and operating means for operating the pump responsive to said angular movement of the ankle cuff.

2. A ski boot as in claim 1 in which said ankle cuff has an anterior side facing in a direction toward the toe portion of the boot shell with the anterior side moving in a substantially longitudinally extending vertical plane relative to the toe portion responsive to said angular movement of the ankle cuff; said pump comprises a housing together with an actuating member carried by the housing, said actuating member being mounted for relative movement with respect to the housing to cause said pumping of air from the interior cavity; and means for interconnecting said housing and actuating member between said anterior side and the toe portion with the housing and actuating member being aligned within said vertical plane whereby said angular movement causes said relative movement of the actuating member with respect to the housing.

3. A ski boot as in claim 1 in which said ankle cuff has a posterior side facing in a direction toward the heel portion of the boot shell with the posterior side moving in a substantially longitudinally extending vertical plane relative to the heel portion responsive to said angular movement of the ankle cuff; said pump comprises a housing together with an actuating member carried by the housing, said actuating member being mounted for relative movement with respect to the housing to cause said pumping of air from the interior cavity; and means for interconnecting said housing and actuating member between said posterior side and the heel portion with the housing and actuating member being aligned within said vertical plane whereby said forward and backward angular movement causes said relative movement of the actuating member with respect to the housing.

4. A ski boot as in claim 1 in which said ankle cuff has a medial side facing in a direction toward the medial side of the boot shell with the medial side moving in a substantially longitudinally extending vertical plane relative to the heel portion responsive to said angular movement of the ankle cuff; said pump comprises a housing together with an actuating member carried by the housing, said actuating member being mounted for relative movement with respect to the housing to cause said pumping of air from the interior cavity; and means for interconnecting said housing and actuating member between said medial side and the boot shell with the housing and actuating member being aligned within said vertical plane whereby said angular movement causes said relative movement of the actuating member with respect to the housing.

5. A ski boot as in claim 1 in which said ankle cuff has a lateral side facing in a direction toward the lateral side of the boot shell with the lateral side moving in a substantially longitudinally extending vertical plane relative to the heel portion responsive to said angular movement of the ankle cuff; said pump comprises a housing together with an actuating member carried by the housing, said actuating member being mounted for relative movement with respect to the housing to cause said pumping of air from the interior cavity; and means for interconnecting said housing and actuating member between said lateral side and the boot shell with the housing and actuating member being aligned within said vertical plane whereby said angular movement causes said relative movement of the actuating member with respect to the housing.

6. A ski boot as in claim 1 in which said pump comprises a housing having a cylindrical chamber together with a piston mounted for reciprocating motion within the chamber between suction and exhaust strokes, said housing having a proximal end connected with the boot shell and the piston having a proximal end connected with the ankle cuff to cause said pumping of air from the interior cavity, means for pneumatically connecting said chamber with said interior cavity during said suction stroke and means for pneumatically connecting said chamber with the atmosphere during said exhaust stroke so that air is pumped out of the interior cavity during said reciprocating motion.

7. A ski boot as in claim 6 which includes means for releasably disconnecting said proximal end of the piston from the boot shell so that the user can manually move the piston in its reciprocating motion for pumping air out of the interior cavity.

* * * * *